United States Patent [19]

Doerksen

[11] Patent Number: 4,886,231

[45] Date of Patent: Dec. 12, 1989

[54] FOLDABLE BOOKSTAND

[76] Inventor: Bradley L. J. Doerksen, 402 Whitegates Crescent, Winnipeg, Manitoba, Canada, R3K 1L8

[21] Appl. No.: 289,800

[22] Filed: Dec. 27, 1988

Related U.S. Application Data

[63] Continuation of Ser. No. 66,066, Jun. 24, 1987, abandoned.

[51] Int. Cl.[4] ..... A47B 97/08

[52] U.S. Cl. ..... 248/455; 248/205.2; 248/444.1; 248/460; 248/453

[58] Field of Search ..... 248/455, 444.1, 447, 248/449, 453, 459, 205.2, 463, 465, 451, 452; 281/33, 45, 42

[56] References Cited

U.S. PATENT DOCUMENTS

| | | | |
|---|---|---|---|
| 324,397 | 8/1885 | McClure | 248/453 |
| 458,438 | 8/1891 | Wilkins | 248/451 |
| 2,012,551 | 8/1935 | Steen | 248/463 X |
| 2,165,255 | 7/1939 | Hamilton | 248/455 |
| 2,373,617 | 4/1945 | Tiryakian | 248/453 |
| 2,726,835 | 12/1955 | Hummel | 248/459 |
| 4,116,413 | 9/1978 | Andersen | 248/451 |
| 4,163,539 | 8/1979 | Awofolu | 248/452 |
| 4,318,471 | 3/1982 | Hutton | 248/459 X |
| 4,318,527 | 3/1982 | Smith | 248/459 |
| 4,679,757 | 7/1987 | Mussari | 248/463 |

FOREIGN PATENT DOCUMENTS

| | | | |
|---|---|---|---|
| 94030 | 9/1987 | Fed. Rep. of Germany | 248/455 |

*Primary Examiner*—RamonS. Britts
*Assistant Examiner*—Karen J. Chotkowski
*Attorney, Agent, or Firm*—Adrian D. Battison; Stanley G. Ade; Murray E. Thrift

[57] ABSTRACT

A portable bookstand is formed from a sheet of rigid card with transverse hinge lines dividing the card into a number of panels to form a base panel, an upstanding front panel, a rearwardly inclined edge receiving panel, an upwardly inclined book face receiving panel and a rearward support structure. Hook and loop fasteners are provided to connect the junction line between the inclined panels to the base panel and to adjustably position the support panel structure to provide different inclinations of the book receiving panel. The device can be folded flat by lifting the inclined panels away from the base panel to allow the support panel to fold in between. Separate arms are pivotally and swivally mounted on the front inclined surface so that they can project upwardly and rearwardly from outer edges thereof to outer edges of the book receiving panel to engage the outer edges of the book.

9 Claims, 3 Drawing Sheets

FOLDABLE BOOKSTAND

This is a continuation of co-pending application Ser. No. 07/066,066 filed on June 24, 1987 and now abandoned.

BACKGROUND OF THE INVENTION

This invention relates to a foldable stand for receiving and supporting a book or other reading material for reading.

Various styles and designs of book stands have been provided both as disclosures in prior patents and in products available on the market place. These have many differing disadvantages which limit their use in particular ways. For example, some devices constitute merely an inclined surface on which a relatively flat paper can satisfactorily lean and be available for study. However the devices of this type are not suitable for receiving various types of books which have a tendancy to close or tendancy to slip away from the surface and collapse. Examples of this type of device are shown in U.S. Pat. Nos. 1,724,492 (MANUS) and 3,195,850 (STEINER). Both of these devices are formed from foldable card with hinge lines in the card defining different panels which constitute a base, a book receiving surface and a support wall.

Other devices are more complex in construction but have a disadvantage that they are relatively bulky and cannot be folded flat for transportation and hence are difficult to transport for example from home use to a library use. Yet further devices have a limitation that the angle of inclination of the book receiving surface is effectively fixed thus limiting the use of the device in a particular way since different positions or uses of the device often require different inclinations of the surface and hence the book or papers being read.

SUMMARY OF THE INVENTION

It is one object of the present invention, therefore, to provide an improved book stand which overcomes one or more of the disadvantages.

According to the first aspect of the invention, therefore, there is provided a foldable stand for receiving and supporting books comprising a single sheet of substantially rigid board material having a plurality of transverse hinge lines thereon defining, in an erected condition thereof, a base panel, an upstanding front panel hingedly connected to said base panel at a front edge thereof, an inclined edge receiving panel, for receiving and supporting an edge of a book, hingedly connected to said front panel at an upper edge thereof and inclined downwardly therefrom to a lower rear edge of said of edge receiving panel so as to contact said base panel at an intermediate position thereon, means for connecting said lower rear edge of said edge receiving panel to said base panel, a face receiving panel connected to said edge receiving panel at said lower rear edge, for receiving and supporting a rear face of said book, and a support panel section hingedly connected to said face receiving panel at an upper edge of said face receiving panel, said support panel section including means for releasably engaging said base panel to retain said face receiving panel at an inclined orientation.

Preferably, said means connecting said lower rear edge and said base panel is arranged to allow at least a part of said support panel section to pass therethrough to allow folding collapse of said stand into a flattened condition.

Preferably, the interconnection between the edge receiving panel and the face receiving panel is releasably connectable to the base panel so that the support panel section can be inserted therebetween in the collapsed condition thereof.

Preferably, the support panel section includes an inwardly turned portion which lies parallel to the base panel and is attachable thereto at a number of different positions thus altering the angle of an upstanding support panel.

Preferably, the support panel also includes a transverse hinge line with an upper part lying parallel to the face receiving panel and a lower part inclined downwardly and rearwardly therefrom to a rear edge of the lower portion.

This structure therefore enables the stand to be folded flat or substantially flat in a collapsed condition thereof and in addition the unique support panel structure enables the inclination of the face receiving panel to be significantly altered for example between approximately 20° and approximately 60° to the horizontal.

Preferably the device includes a pair of separately moveable arms each of which is mounted on the edge receiving surface adjacent a side edge thereof and is moveable so that a remote end of the arm can engage the face receiving panel at an outer side edge thereof and approximately the mid height thereof so as to engage the book sitting on the stand at the outer sides of pages so that they are readily viewable and can also be turned without difficulty.

According to a second aspect of the invention there is provided a stand for receiving and supporting a book comprising a base member for resting upon a substantially horizontal surface, means defining a first surface having a front edge thereof adjacent a front of the base member and a rear edge thereof substantially parallel to the front edge and intermediate a depth of the base member, the surface being inclined downwardly from said front edge towards said rear edge, means defining a second surface having a front edge adjacent the rear edge of the first surface and a rear edge rearwardly and upwardly of the front edge of the second surface such that the second surface is inclined upwardly from said front edge thereof such that a book can be placed with an edge resting on said first surface and a rear thereof resting on said second surface, and a pair of arms each having one end thereof mounted adjacent a respective side edge of said first surface and an opposed end, each said arm being moveable from a position in which the opposed end lies adjacent said first surface to a second position in which said opposed end lies on said second surface adjacent a side edge of said second surface.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
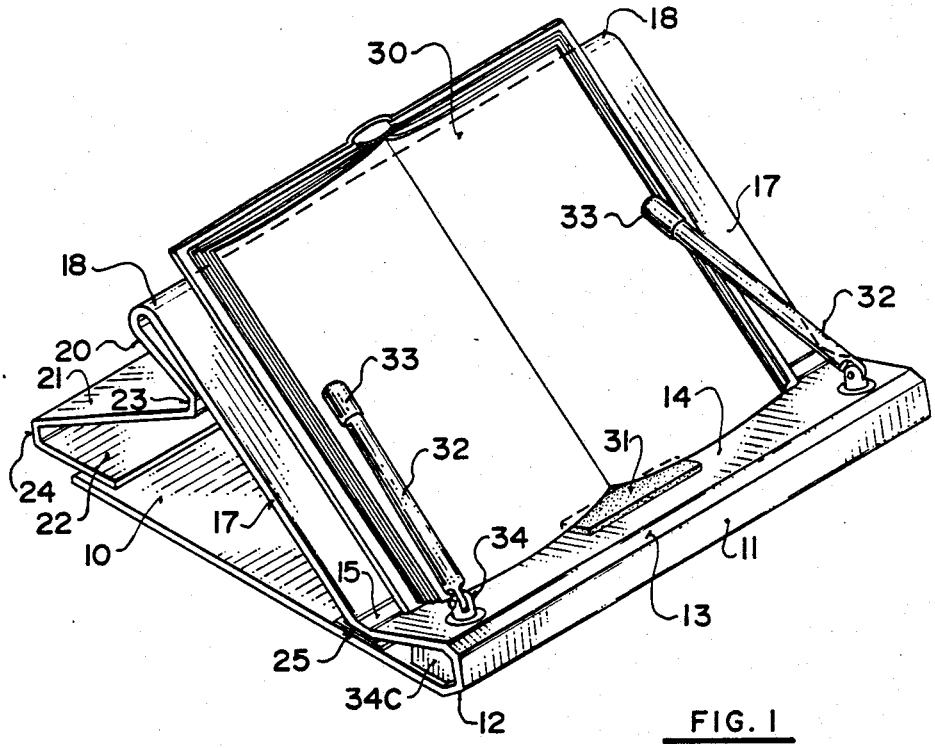
FIG. 1 is an isometric view of a bookstand according to the invention.

The bookstand according to the invention is formed from a sheet of board material of the type which is suitably covered by an attractive and wear resistant coating and is commonly employed in the manufacture of a three ring binder and the like. Such board are relatively rigid and form for example from 1/16 inch cardboard which provides the necessary rigidity but which can be provided with crease or fold lines to allow it to readily bend at the required locations. The techniques for forming such fold lines and for forming the basic blanks from which the device is manufactured are well known in the trade and accordingly will not be described in detail here.

However, it will be appreciated that the bookstand is effectively formed from a single sheet or strip of the board material which is formed with transverse fold lines as shown and as described hereinafter.

Specifically the bookstand comprises a base panel 10 which is rectangular and of a size sufficient to provide a stable base when resting upon a horizontal surface for example table, desk or the like. An upstanding front panel 11 is connected at a lower edge 12 thereof to a front edge of the base panel 10. The panel 11 is relatively narrow and can be in one example the order of one inch high which is similar to the back of a common three ring binder.

The upstanding front panel has an upper edge 13 at which there is provided a further hinge line interconnecting that panel to an edge receiving panel 14 which is of a depth of the order of two inches which is significantly less than the depth of the base panel 10. The edge receiving panel 14 inclines downwardly and rearwardly from the front edge 13 to a point of interconnection indicated at 15 between the panel 14 at its rear most edge and the best panel 10. A hinge line is provided at the rear edge of the edge receiving panel 14 from which a book face receiving panel 17 extends upwardly and rearwardly in an inclined orientation. The depth of the panel 17 is such that the sum of the depth of the panel 14 and the panel 17 is substantially equal to the depth of the panel 10.

Figure 2:
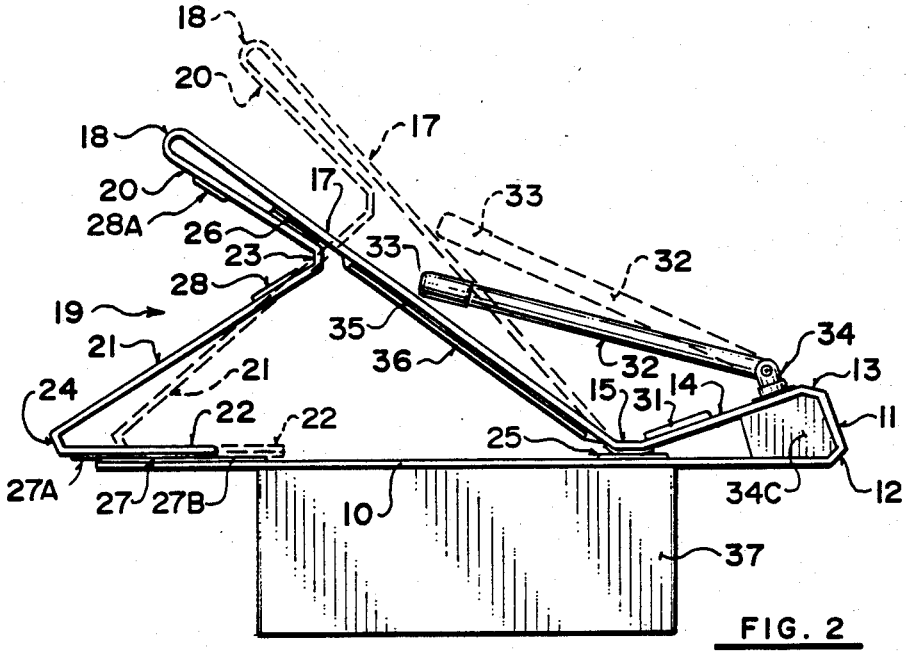
FIG. 2 is a side elevational view of the bookstand of FIG. 1.

At an upper edge of the panel 17, a further hinge line 18 is provided which connects that panel 17 to a support panel structure generally indicated at 19 and consisting of three panel parts indicated at 20, 21 and 22 respectively. The hinge line 18 is designed to allow hinging of the panel part 20 so that it can lie either directly back against the rear surface of the panel 17 or substantially at right angles thereto. In order to easily accomodate such movement, the hinge line 18 may consist of two separate hinge lines. A second hinge line 23 interconnects the parts 20 and 21 consists of two hinge lines in opposing formation and allows hinging from a position in which the parts 20 and 21 are in line to a position as shown in FIG. 2 in which the part 21 is approximately at right angles to the part 20 and to a position shown in FIG. 3 in which the parts 20 and 21 are approximately at right angles in the opposite direction. A further hinge line 24 is provided between the part 21 and the part 22.

Suitable connecting means for interconnecting the parts together are provided at various locations on the panels. Preferably the connecting means comprises hook and loop fabric strips with one part carrying hooks being attached to one of the panels and the other part carrying loops attached to the other of the panels for the conventional interconnection which is of course readily releasable.

Thus a first interconnection is indicated at 25 and is provided between the interconnection point 15 and the upper side of the base panel 10 so as to hold the lower most edge of the panel 17 tight against the base panel 10 when in the erected position shown in FIGS. 1 and 2. The connection can of course be released when required. A further interconnection is shown at 26 and is provided between the adjacent surfaces of the panel 17 and the panel part 20 so as, when connected, to hold those panels in closely adjacent relationship. A yet further interconnection is indicated at 27 and is provided between the underside of the panel part 22 and the upper surface of the base panel 10. As shown the extent of the hook and loop fabric strips provided on the underside of the part 22 and the upper surface of the base panel 10 are longer in a direction longitudinal to the panel 10 than is necessary for the interconnection so that the angle of the panel part 21 to the base panel 10 can be adjusted by moving the part 22 forwardly and rearwardly on the panel 10 thus changing the inclination of the book receiving face of the panel 17. In the examples shown, this adjustment may be achievable between angles of 25° degrees to 55° degrees of the panel 17 to the horizontal.

Figure 3:
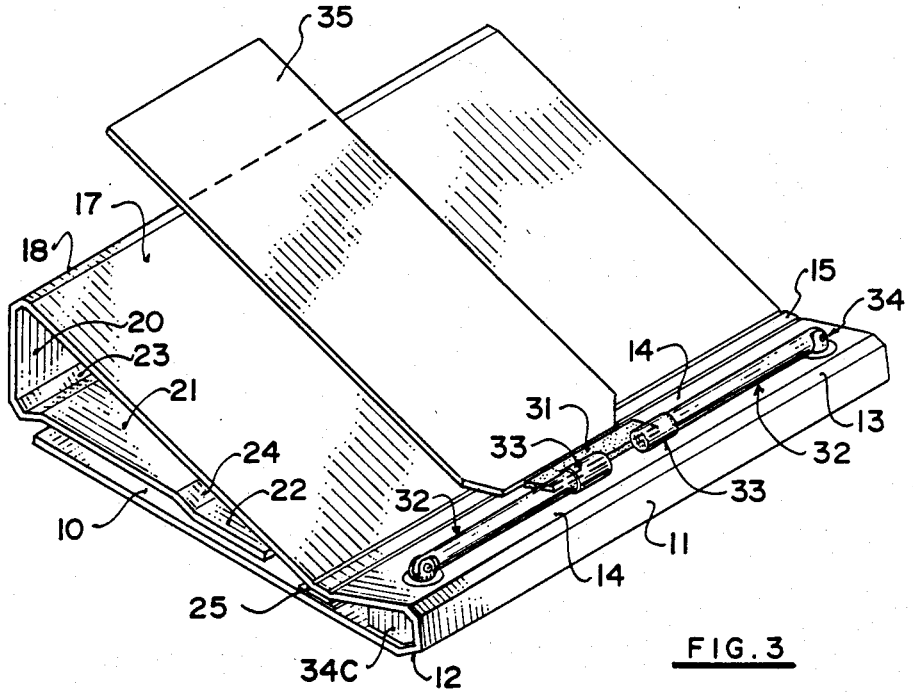
FIG. 3 is an isometric view of the bookstand of FIG. 1 in which the panels have been moved to obtain a lower inclination of the book support surface.

The outer surface of the panel part 21 also includes a strip of the connecting means indicated at 28 of the type which cooperates with the strip on the upper side of the panel 10 so that the stand can take up the position shown in FIG. 3 in which the panel 20 is pivoted away from the panel 17 to a position generally at right angles thereto so as to support the panel 17 at a significantly reduced angle which is of the order of 18° degrees.

Figure 4:
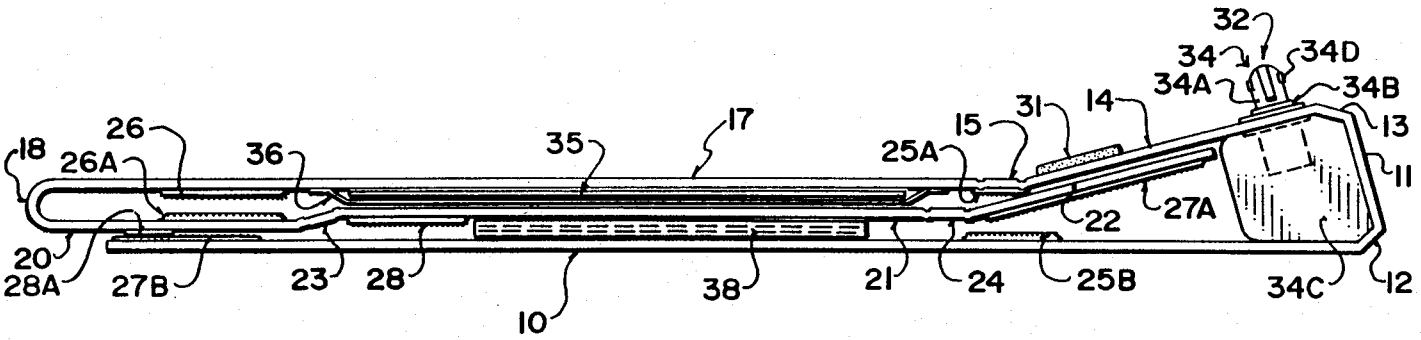
FIG. 4 is a side elevational view of the bookstand of FIG. 1 in a collapsed or folded condition thereof.

A collapsed condition of the stand is shown in FIG. 4 which is achieved simply by separating the interconnection 25 so as to provide two separate parts 25A and 25B, disconnecting the interconnection 27 so as to provide two parts 27A and 27B. The edge part 22 of the support panel structure can then be moved forwardly into the area beneath the panel 14 and through the disconnected parts 25A and 25B.

To assist in supporting the book generally indicated at 30 on the device as shown in FIG. 1, a foam pad 31 is attached to the panel 14 on the upper surface thereof adjacent the lower most edge thereof so that papers or the edge of a book rest against the foam pad and are prevented from sliding upwardly along the panel 14. The foam pad has a depth of the order of one half inch and transverse width of the order of two or three inches so that it can cooperate with pages of a book across the width of the book and through the depth of for example a thick text book.

For use with books which have a tendancy to close or for pages to move without further support, a pair of arms is provided for engaging pages of the book on either sides of the spine to hold them in the opened condition as shown in FIG. 1. Each of the arms comprises a rigid member indicated at 32 with a rubber tip 33 at an upper end and a pivotal coupling 34 at a lower end. The pivotal coupling 34 is mounted adjacent the side edge of the panel 14 so that the arms are spaced well outwardly of the panel 14 toward the side edges and also adjacent the front edge 13 of the panel 14. The pivotal couplings 34 are of a type including a boss 34A mounted in a sleeve 34B to allow rotation about an axis longitudinally of the arm. The sleeve 34B is mounted within the panel 14 at right angles thereto and is embedded in a suitable structural member 34C in the area underneath the panel 14 and immediately adjacent the front panel 11 and secured thereto.

The arms are of a length such that they can move from a retracted and stored position shown in FIG. 3 in which each of the arms is folded inwardly and lies directly along the panel 14 with the rubber ends lying closely adjacent but not touching. The erected condition is shown in FIG. 1 in which the arms move substantially directly upwardly but inclined rearwardly from the pivot coupling 34 to a position at the side edges of the panel 17 and approximately at the mid height of the panel 17 so as to engage a book again approximately at its mid height and adjacent the outer edges of the pages so as not to interfere with vision of the material on the pages.

The arms are pivotal about an axis transverse to the swivel axis by way of a coupling 34D to allow the forward and rearward movement necessary to accomodate the storage position and the erected condition shown in FIGS. 1 and 3. The arms are free from spring bias but the swivel 34A and the pivot 34D both include a mechanical friction which acts to hold the arm at a set position.

Further separate features of the invention comprise a sheet of substantially rigid board indicated at 35 which is of a length substantially equal to the width of the stand and of a width so that it can just be received within a storage pouch 36 on the underside of the panel 17. In FIG. 3 the board 35 is shown in the extracted and assembled position so that it lies along the panel 17 beyond the upper edge of the panel 17 so as to support for example single pages where necessary which do not have themselves sufficient rigidity to avoid bending over the upper edge of the panel 17. In FIG. 4 the panel is placed into the storage pouch 36 where it can remain both in the collapsed and erected conditions or can be removed for use as required. The board 35 has clipped corners at one end to allow easy insertion into the storage pouch.

In addition a base 37 is provided which is shown in FIG. 2 underneath the base panel 10. The base 37 is preferably of square plan with rectangular walls which are held apart by suitable spacers all of which can be folded flat and inserted into the interior of the stand as indicated at 38 in FIG. 4. When assembled and placed under the panel 10, the base 37 acts to reduce the footprint of the stand so that other papers or objects can be brought up into close proximity to the stand for example for writing.

The device according to the present invention has therefore a number of advantages.

Firstly, the case is simple in that its main body is one piece of cardboard with folds. Even the ledge on which the book is placed is part of the main body. The ledge being triangular has spaced inside it for the mounting of arms of the type shown or of other designs which are movable to hold the book open. The space can be used for a long plastic bar which can provide strong backbone or spine to add strength to the design as well as provide the place to mount the arms.

The stand in the collapsed condition resembles a three-ring binder so that it is of a familiar appearance and familiar to handle and carry by students or other persons well acquainted with such binders. One of the major features in case of use for example in carrying the stand, preferably the rounded edge 18 extends over the straight edge of 10 so as to be easy on the hand when carried adjacent to the body like a book or binder. Also books may be placed on top of face 17 and carried as one normally carries his books. The effective thickness of the stand when carried with other books is approximately ½ inch. The rubber pad on the ledge of the stand prevents books from slipping and being spongy is less damaging to a book then would be a hard upstanding stop edge or the like. The panel 17 contacts a back face of a book from a position above the centre of the book all the way to the base and hence provides complete back support for the book.

The design provides a substantially continous slope adjustment between 18° and 55° which is easily adjustable by using the hook and loop strip fasteners which hold the stand in its required erected form. The holding power of the fasteners is very strong and the slope adjustment of the stand will not accidentally change due to slippage.

The low slope of the device as shown in FIG. 3 is very suitable for classrooms or boardrooms where it is desirable not to obstruct the view between the user and others for example an instructor. Due to the folding design of the device, the low slope setting does not cause the panels to protrude. This keeps the stands "footprint" small in size basically defined by the base panel 10 and keeps it looking neat. The low slope setting also allows the stand to be placed in the users lap or used in a car, or other vehicle.

The arms can be adjusted to hold almost any size of book from the smallest paperback to a large encyclopedia in a fairly flat state and without any text obscured. Each of the arms is independant of the other so that it can adjust for the thickness of a large book when it is opened to the first few pages, the middle or the last few pages. The arms are not spring loaded but use mechanical friction so that they can make use of the natural springiness of the book. This allows pages in all but very large books to be turned with just one hand so that each page slips out from one of the arms and can be simply placed under the other arm without difficulty. It is only necessary after a number of pages have been turned to readjust the position of the arms to accomodate the difference in thickness which has occurred. The arms hold the book flat without using distracting bars or elastic bands running across the front of the book. If the arms are set properly, no text is obscurred on small or large books and underlining or highlighting can be easily done. As the arms are inclined to the front place of the book a small ruler of the like can be slid underneath the arms if required by the user.

Large books may require arms to be placed at the base of the book or in a combination of one arm at the side and one arm at the base of the book. In this case turning of pages may require some movement of the arms set at the base of the book. Note, however, that many of the larger sized books require little or no arm support at all, in which case the arms can be placed in their "home" position and will be completely out of the way for the reading of the book.

Figure 5:
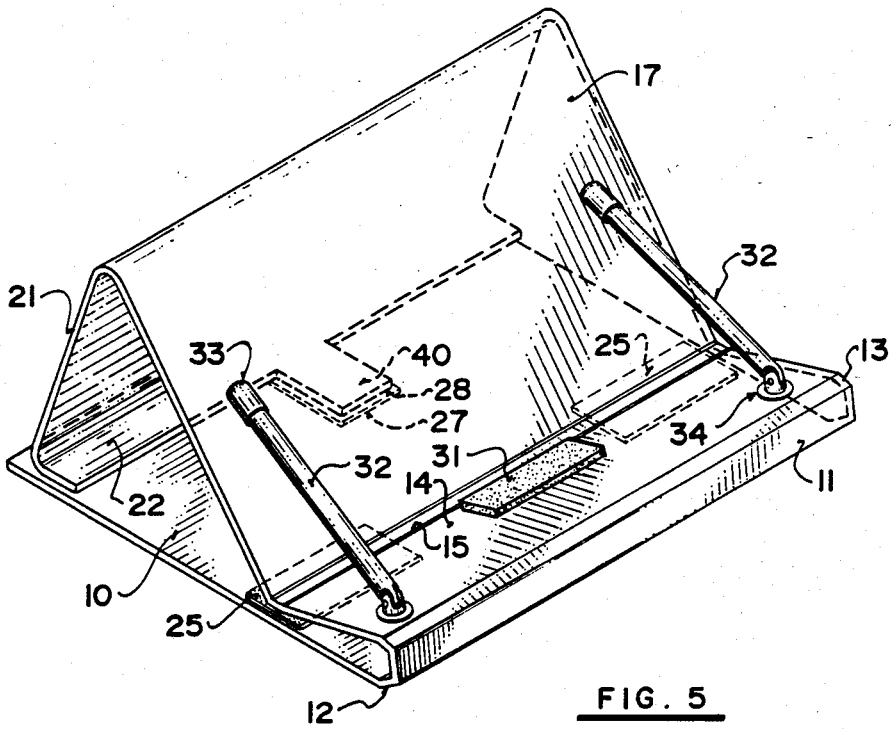
FIG. 5 is an isometric view of an alternative construction of bookstand according to the invention.

An alternative construction is shown in FIG. 5 and is modified by the absence of the hinge line 23, the interconnection 26 and the strip of connecting member 28. In order to provide an increased amount of inclination adjustment of the panel 17, a tab 40 is provided extending outwardly from the edge of the panel 22 so as to yet further increase the movement of the lower end of the support panel structure across the base panel 10.

Since various modifications can be made in my invention as hereinabove described, and may apparently widely different embodiments of same made within the spirit and scope of the claims without departing from such spirit and scope, it is intended that all matter contained in the accompanying specification shall be interpreted as illustrative only and not in a limiting sense.

I claim:

1. A foldable stand for receiving and supporting books comprising a single sheet of substantially rigid board material having a plurality of transverse hinge lines thereon defining, in an errected condition thereof, a base panel, an upstanding front panel connected to said base panel at a front edge thereof, an inclined edge receiving panel, for receiving and supporting an edge of a book, connected to said front panel at an upper edge thereof and inclined downwardly therefrom to a lower rear edge of said edge receiving panel which contacts said base panel at an intermediate position thereon, means for connecting said lower rear edge of said edge receiving panel to said base panel, a face receiving panel hingedly connected to said edge receiving panel at said lower rear edge for receiving and supporting a rear face of said book, and a support panel section hingedly connected to said face receiving panel at an upper edge of said face receiving panel for engaging said base panel to retain said face receiving panel at adjustably inclined orientations relative to said base panel, said support panel section including a first panel part hingedly connected to said upper edge of said face receiving panel, a second panel part hingedly connected by a first transverse hinge line to a lower edge of said first panel part, and a third panel part hingedly connected to a lower edge of said second panel part by a second transverse hinge line, said first transverse hinge line being shaped to allow pivotal movement of the second panel part relative to the first panel part to both sides of a position in which the parts are coplanar so as to allow movement of the support panel section from a first position in which the first panel part lies along side the face receiving panel, in which said second panel part extends outwardly from the face receiving panel to support the face receiving panel at a first angle to the base panel and in which the third panel part lies along side the base panel, to a second position in which the first panel part extends outwardly from the face receiving panel and the second panel part extends along side the base panel in a direction underneath said face receiving panel to support the face receiving panel at a second lower angle to the base panel, first fastening means which is releasable and refastenable on an inner face of the first panel part for connecting the first panel part to the undersurface of the face receiving panel, second fastening means which is releasable and refastenable on an outer face of the second panel part for connecting said second panel part to an upper surface of the base panel in said second position, and third fastening means which is releasable and refastenable on an outer surface of the third panel part for connecting the third panel part to an upper surface of the base panel in said first position.

2. The invention according to claim 1 wherein said means connecting said lower rear edge of said edge receiving panel and said base panel is arranged to allow at least a part of said third panel part to pass therethrough to allow folding collapse of said stand into a flattened condition with said support panel section lying between said face receiving panel and said base panel and parallel thereto.

3. The invention according to claim 1 wherein said means connecting said lower rear edge of said edge receiving panel to said base panel includes releasable and refastenable means so as to allow said lower rear edge to be separated from the base panel.

4. The invention according to claim 1 wherein the extent of said edge receiving panel and said face receiving panel from said upstanding panel is substantially equal to the extent of the base panel from said upstanding panel and wherein the extent of said support panel section from said upper edge of said face receiving panel to a lowermost edge of the third panel part which is substantially equal to but less than the extent of said base panel such that said support panel section can be received along side said base panel and rearwardly of said upstanding panel in said collapsed condition.

5. The invention according to claim 1 including a pad member of resilient foam material provided on said edge receiving panel at a position adjacent said lower rear edge thereof.

6. The invention according to claim 1 including a separate planar board and means for storing said board intermediate said face receiving panel and said base panel in said collapsed condition thereof.

7. The invention according to claim 1 including a pair of arms, each arm consisting solely of an elongate rod member having pivotal mounting means on one end and a rubber tip member on an opposed end, said pivotal mounting means mounting said one end of said rod member on said edge receiving surface adjacent a respective side edge of the edge receiving surface, said pivotal mounting means defining two axes about both of which said rod member can rotate, which axes are mutually at right angles so that said pivotal mounting means provides movement of said opposed end of said arm in a sphere around said pivotal mounting means defined by a first degree of movement in an arc between a first position in which said opposed end lies adjacent said edge receiving surface and a second position in which said opposed end lies on said face receiving surface adjacent a side edge of said face receiving surface and a second degree of movement in a direction towards and away from said second surface, each of said arms having a length such that said arms can extend from the pivotal mounting means thereof to a position adjacent a midpoint of the edge receiving surface, and said pivotal mounting means having means providing frictional resistance to said movement of said rod members such that the arm can be maintained against gravity at any position thereof by said frictional resistance.

8. The invention according to claim 1 wherein the extent of said first panel part from said upper edge of said face receiving panel to said first transverse hinge line is less than the extent of the second panel part from said first transverse hinge line to said second transverse hinge line.

9. A foldable stand for receiving and supporting books comprising a single sheet of substantially rigid board material having a plurality of transverse hinge lines thereon defining, in an errected condition thereof, a base panel, an upstanding front panel connected to said base panel at a front edge thereof, an inclined edge receiving panel, for receiving and supporting an edge of a book, connected to said front panel at an upper edge thereof and inclined downwardly therefrom to a lower rear edge of said edge receiving panel which contacts said base panel at an intermediate position thereon, means for connecting said lower rear edge of said edge receiving panel to said base panel, a face receiving panel hingedly connected to said edge receiving panel at said lower rear edge for receiving and supporting a rear face of said book, and a support panel section hingedly connected to said face receiving panel at an upper edge of said face receiving panel for engaging said base panel to retain said face receiving panel at adjustably inclined orientations relative to said base panel, and a pair of arms, each arm consisting solely of an elongate rod member having pivotal mounting means on one end and a rubber tip member on an opposed end, said pivotal mounting means mounting said one end of said rod member on said edge receiving surface adjacent a respective side edge of the edge receiving surface, said pivotal mounting means defining two axes about both of which said rod member can rotate, which axes are mutually at right angles so that said pivotal mounting means provides movement of said opposed end of said arm in a sphere around said pivotal mounting means defined by a first degree of movement in an arc between a first position in which said opposed end lies adjacent said edge receiving surface and a second position in which said opposed end lies on said face receiving surface adjacent a side edge of said face receiving surface and a second degree of movement in a direction towards and away from said second surface, each of said arms having a length such that said arms can extend from the pivotal mounting means thereof to a position adjacent a midpoint of the edge receiving surface, and said pivotal mounting means having means providing frictional resistance to said movement of said rod members such that the arm can be maintained against gravity at any position thereof by said frictional resistance.

* * * * *